US006029281A

United States Patent [19]

Battley

[11] Patent Number: 6,029,281

[45] Date of Patent: Feb. 29, 2000

[54] CLOTHING INSERT

[76] Inventor: Anne Catherine Battley, "Gelfro", RMB 815, Williams, Western Australia, 6391, Australia

[21] Appl. No.: 08/368,359

[22] Filed: Jan. 4, 1995

[51] Int. Cl.[7] ..... A41B 9/00

[52] U.S. Cl. ..... 2/406; 2/400

[58] Field of Search ..... 2/2, 1, 22, 23, 2/24, 16, 267, 268, 243.1, 44, 92, 400, 401, 402, 403, 406, 408; 450/53, 54, 55, 56, 57, 30, 31, 32

[56] References Cited

U.S. PATENT DOCUMENTS

| | | | |
|---|---|---|---|
| 3,392,731 | 7/1968 | Silverman | 450/57 |
| 3,502,083 | 3/1970 | Howard et al. | 450/56 X |
| 3,619,819 | 11/1971 | Mann | 450/54 X |
| 3,646,614 | 3/1972 | Engelmann | 2/91 |
| 4,301,548 | 11/1981 | Blake | 2/91 |
| 4,462,115 | 7/1984 | Carlson et al. . | |
| 4,472,838 | 9/1984 | McMurray . | |
| 4,484,361 | 11/1984 | Leighton et al. . | |
| 4,669,125 | 6/1987 | Allen . | |
| 4,675,912 | 6/1987 | Kirkland . | |
| 5,271,101 | 12/1993 | Speth et al. | 2/267 |
| 5,388,275 | 2/1995 | Oram | 2/406 |
| 5,392,467 | 2/1995 | Moretz et al. | 2/406 |

FOREIGN PATENT DOCUMENTS

| | | |
|---|---|---|
| 53164/64 | 6/1966 | Australia . |
| 7881/66 | 1/1968 | Australia . |
| 78693/87 | 6/1988 | Australia . |
| 56082/90 | 5/1990 | Australia . |
| 44649/89 | 6/1990 | Australia . |
| 853467 | 11/1960 | United Kingdom . |

OTHER PUBLICATIONS

International Type Search Report.

*Primary Examiner*—Gloria M. Hale
*Attorney, Agent, or Firm*—Knobbe, Marten, Olson & Bear LLP

[57] ABSTRACT

A pants insert to be located within a pair of pants where the insert is to be worn between the skin of the wearer and the pants to overlie the region of the crotch and/or buttocks of the wearer which is to be subjected to pressure, said insert being formed of fleeced sheep skin and being located such that the fleece of the sheep skin is adjacent the skin of the wearer, said insert being configured to lie against the region of the crotch and/or buttocks to be subjected to pressure.

9 Claims, 1 Drawing Sheet

CLOTHING INSERT

This invention relates to an insert which is to be used in association with a pair of pants in order to protect regions of the crotch and/or buttocks of a wearer which may be subjected to pressure.

It has been found that in instances where persons are involved in an activity which results in continuous pressure being applied to a portion of the body, that not only can the person experience some discomfort, but there can also be considerable physiological difficulty for the wearer such as the development of pressure sores or infection. Such activities include horse riding, bicycle riding, rowing, sedentary occupations or like activities where a portion of a persons body is subjected to pressure for extensive periods of time. Similar difficulties can also arise in the case of bed-ridden patients who develop pressure sores.

Previously persons involved in sports which involved pressure being applied to portions of the body for extensive periods of time (e.g. horse riding, cycling, rowing) have worn beneath their sporting attire, conventional underpants which may be formed of a simple woven material such as being a cotton or cotton synthetic mix. In some cases the clothing which is worn over the underpants has been very tight fitting and substantially non yielding. As a result of such is that there is little or no air circulation in the region of the skin which is being subjected to pressure, there is extremely limited heat transfer from that region. These two characteristics alone can result in significant physiological detriment to the wearer which can cause lasting damage to the tissue and can be detrimental to the persons continued sporting performance.

In the case of horse riding, the appropriate body movements for horse riding, particularly in the pelvic region, can result in considerable discomfort for the rider. This often results in chafing of various degrees of seriousness which can include breaking of skin tissue and bleeding and bruising. In addition, due to imbalance some inexperienced riders can suffer from unequal pressure in the region of the seat bones and/or pubic bones. Furthermore during long training periods in the saddle and in particular during the hot summer months the perspiration which results in those areas can result in scolding and infection of the skin tissue. It is also a characteristic of horse riding, and in particular with those riders who lack experience, that the body of the rider is regularly thrown from the saddle which results in the rider impacting onto the saddle and in particular the pommel of the saddle (i.e. the raised front portion of the saddle) or the seat of the saddle which results in repetitive and often unusually heavy contact. This can create bruising, abrasion, skin damage and like injury.

In the case of cycling similar problems are experienced as those experienced by horse riders. One particular difference between the two activities however, is the pressure exerted on the seat bones and the pubic bones of the wearer, which can be greater. The seat saddle on the bicycle is considerably narrower and shorter and has less surface area to support the rider. Although there is little of the backward and forward motion on the part of the cyclist in comparison with a horse rider, very considerable pressure is applied to the crotch and buttock area of the rider at different times resulting in different effects. Research has shown that many male cyclists experience problems as a result of pressure being applied in the region of the base of the penis which can result in prostatitis (inflammation of the prostate gland).

Furthermore, because of the nature of the activity involved in cycling, considerable perspiration can be produced in the region of the groin and buttocks which can exacerbate the chafing and the likelihood of infection.

In the past materials such as synthetic chamois or genuine chamois and other alternative forms of padding have been utilised as inserts in clothing, however they all have the disadvantage that they do not facilitate the diffusion of heat to or from the crotch or buttock area and they provide an ideal environment which together with the moisture and warmth being created in the area is conducive to bacterial and fungal infection. In addition, the nature of the materials is such that the skin of the wearer in the region of the groin or buttock tends to slide over the surface or alternatively become stuck to the surface which can result in considerable discomfort, scalding and an increased opportunity for infection.

It is an object of this invention to provide a clothing insert which can serve to alleviate some of the difficulties which have been found to occur in circumstances where the portion of the body of a person is subjected to pressure conditions.

In one form the invention resides in a clothing insert to be located within a pair of pants where the insert is to be worn between the skin of the wearer and the pants to overlie the region of the crotch and/or buttocks of the wearer which is to be subjected to pressure, said insert being formed of fleeced sheep skin and being located such that the fleece of the sheep skin is adjacent the skin of the wearer, said insert being configured to lie against the region of the crotch and/or buttocks to be subjected to pressure.

If desired the insert can be removably received within the item of clothing or alternatively the insert can be fixed by any suitable means to the interior of the item of clothing.

According to a preferred feature of the invention the fleece has a fibre length of approximately 2 cm or more and is of medium to heavy density.

The invention will be more fully understood in the light of the following description of one specific embodiment. The description is made with reference to the accompanying drawings of which:

Figure 1:
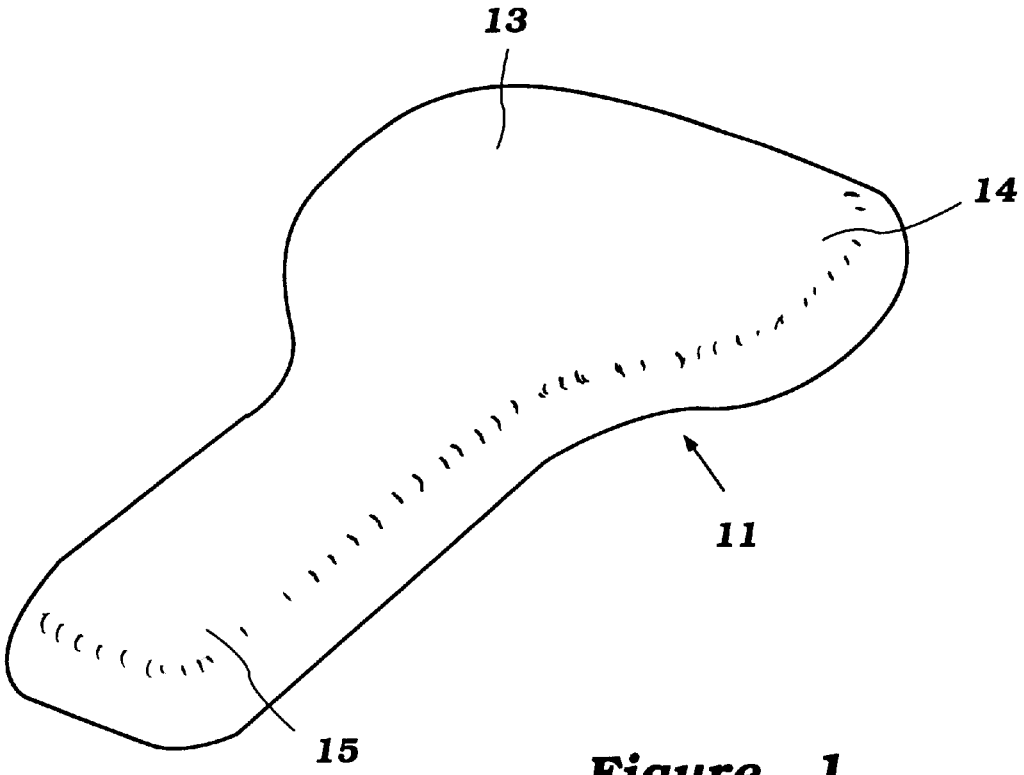
FIG. 1 is an isometric view of the clothing insert according to the embodiment.
Figure 2:
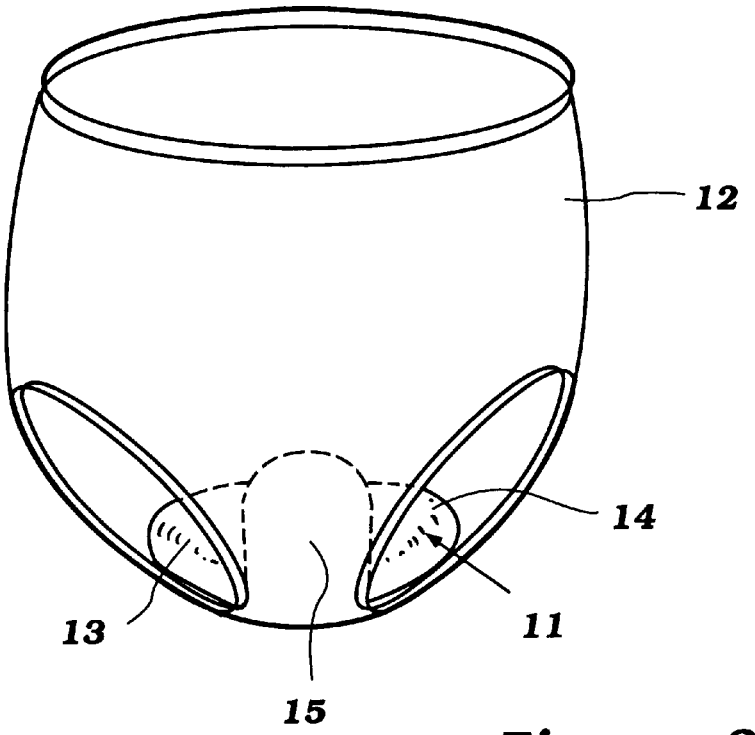
FIG. 2 is a schematic isometric view of a pair of underpants having a clothing insert according to the embodiment located therein.

The embodiment relates to a clothing insert 11 which is to be used in association with a pair of pants which are to be worn by persons who may be involved in an activity requiring them to be seated for an extensive period of time. In particular the embodiment has application for use by persons involved in horse riding, bicycle riding and rowing but it can also be used by persons who are involved in a sedentary occupation where they are required to sit for extensive periods of time.

In each of these occupations the region comprising crotch and/or buttocks of the person are subjected to consistent pressure over a considerable length of time which can vary in intensity throughout that period. As a result of such pressure the person can suffer from considerable discomfort and in many cases such pressure can result in damage to the skin in the region of that pressure and as a result of chafing, scolding or purely sustained pressure. This can result in the development of pressure sores or skin disorders and physiological problems. Furthermore, due to the confinement in the region of the crotch and upper thighs of the wearer, and since such activities involve considerable physical exertion which generates heat and perspiration conditions are established which can result in the development of bacterial and/or fungal infections and this feature together with the high likelihood of damage to the skin can lead to significant problems.

The embodiment comprises an insert 11 formed from fleeced sheepskin where the fleeced portion of the sheepskin is to be located to be against the skin of the wearer. The insert in use, is to be inserted into a pair of pants 12 or alternatively may be fixed into a pair of pants 12 by any suitable fixing means (e.g. the insert may be sewn into the pants or held in a loop hook attachment means such as VELCRO). The configuration of the insert is such that when worn within a pair of pants it will lie against the region of the crotch and/or buttocks of the wearer which is subjected to pressure when seated. As a result the insert has a general T-shape configuration where the two arms 13 and 14 are intended to underlie the portion of the buttocks of the wearer which will be subjected to pressure in use and where the central stem 15 of the insert is to be received in the crotch of the wearer.

As a result of testing it has been found that the insert improves the comfort of the wearer when engaged in activities such as horse riding, cycling and rowing. The insert not only serves to reduce the sensation of pressure experienced by the wearer in use but also serves in preventing damage to the skin or tissue which would otherwise be experienced under normal conditions. This is partly because the skin does not "stick" to the fleece and also does not slide over the fleece. Rather the fleece of the insert moves with the skin and accommodates for relative movement between the skin and the pants in the region of pressure. In addition, the insert allows some air to the region, allows moisture to escape and allows some dissipation of body heat. Furthermore the insert serves to provide an environment which is less favourable for the development of infections when the wearer is undergoing activities which involve physical exertion which activities will result in a warm moist environment in the region of the crotch and/or buttocks as a result of perspiration of the wearer.

In addition when the insert is soiled it can be readily washed.

Variations of the embodiment may be used in association with persons who are involved in circumstances which may involve the establishment of pressure on the body such as may be the case with bed-ridden patients, the occupants of wheelchairs and the like. The scope of the insert can be varied to accommodate for different activities which may create different pressure zones.

It should be appreciated that the scope of the present invention need not be limited to the particular scope of the embodiment described above.

I claim:

1. A pants insert adapted to be located within a pair of pants where the insert is worn between the skin of the wearer and the pants to lie in the region of the crotch and/or buttocks of the wearer which is to be subjected to pressure, said insert being formed of fleeced sheep skin and being located such that the fibers of the fleece of the sheep skin are adjacent the skin of the wearer with the fibers engaging the skin of the wearer to provide air gaps around the wearer's skin and so that the material of the pants can shift relative to the wearer's skin through deflection of the fibers without chafing, said insert being configured to lie against the region of the crotch and/or buttocks to be subjected to pressure.

2. A pants insert as claimed at claim 1 wherein the insert is adapted to be removable received within the pants.

3. A pants insert as claimed at claim 1 wherein the insert is sewn into the pants.

4. A pants insert as claimed at claim 2 wherein the insert is provided with hook and loop attachment means.

5. A pants insert as claimed at claim 1 wherein the fleece has a fibre length of approximately 2 cm or more and is of medium to heavy density.

6. A pants insert as claimed at claim 1 wherein the insert has a generally T-shaped configuration.

7. A pair of pants having a pants insert of the form as claimed at claim 1.

8. A pair of pants as claimed at claim 7 wherein the insert is fixed into the pants.

9. A pair of pants as claimed at claim 7 wherein the pants insert is removably supported in the pants.

* * * * *